US005806538A

United States Patent [19]

Keltner

[11] Patent Number: 5,806,538

[45] Date of Patent: Sep. 15, 1998

[54] HAIR STYLING TOOL

[75] Inventor: Tracy L. Keltner, Bryan, Tex.

[73] Assignee: Keltner & Company, Inc., Mansfield, Tex.

[21] Appl. No.: 946,330

[22] Filed: Oct. 7, 1997

Related U.S. Application Data

[60] Provisional application No. 60/027,770 Oct. 9, 1996.

[51] Int. Cl.[6] ..... A45D 7/00

[52] U.S. Cl. ..... 132/210; 132/212; 132/200; 132/273

[58] Field of Search ..... 132/210, 273, 132/212, 275, 200; 119/801, 808; 223/99, 105; 66/117, 1 A, 4, 118

[56] References Cited

U.S. PATENT DOCUMENTS

| | | | |
|---|---|---|---|
| 635,543 | 10/1899 | Herr | 119/801 |
| 1,131,621 | 3/1915 | White | 66/118 |
| 1,709,631 | 4/1929 | Schmidt | 66/118 |
| 1,730,545 | 10/1929 | Van Dyke | 66/4 |
| 3,889,692 | 6/1975 | Redrow | 132/212 |
| 5,036,870 | 8/1991 | Edmark | 132/273 |
| 5,167,245 | 12/1992 | Harriett | 132/273 |
| 5,279,255 | 1/1994 | Northcutt | 132/212 |
| 5,289,834 | 3/1994 | Lawrence | 132/212 |
| 5,417,230 | 5/1995 | Wood | 132/212 |

*Primary Examiner*—Gene Mancene
*Assistant Examiner*—Pedro Philogene
*Attorney, Agent, or Firm*—Pravel, Hewitt & Kimball

[57] ABSTRACT

A hair styling tool is provided for wrapping hair around and into a hair tail. The hair styling tool includes a U-shaped hook and an arm each attached to and extending outwardly from a handle.

8 Claims, 4 Drawing Sheets

HAIR STYLING TOOL

RELATED APPLICATIONS

This application claims priority to United States provisional application Ser. No. 60/027,770, filed Oct. 9, 1996.

BACKGROUND OF THE INVENTION

1. Field of the Invention

The present invention relates to hair styling tools and methods for their use in hair care. In particular, the present invention relates to a hair styling tool for wrapping hair around and into a hair tail. Additionally, the present invention includes methods for using the hair styling tool to create unique hair styles.

2. Description of the Related Art

Since the beginning of time, men and women have been concerned with the appearance of their hair. For most, hair presentation is an important aspect of one's overall personal appearance. Theories abound why people embrace a particular style and appearance for their hair. Some arrange their hair in a particular style because they consciously want it to reflect their personality. Others select a hair style to project a certain image and still others arrange their hair in a style because it affects how they feel about themselves. Despite all the reasons proffered on why someone selects a particular hair style, most would agree that a good hair day can make an otherwise lousy day almost bearable. As a result, a great deal of time, effort, and money is spent struggling with and arranging one's hair to create that perfect appearance and feeling.

In general, hair artisans would agree that styling and caring for longer hair takes more time, effort, and money than styling and caring for shorter hair. Many reasons exist for this disparity of time and effort between caring for longer and shorter hair. One reason, however, is that longer hair may be arranged in many different styles. For example, long hair may be gathered and bound into hair tails commonly referred to as ponytails, pigtails, puppy tails, and puppy ears. Most often these hair tails are bound or fastened together by some type of fastener, such as an elastic tie, rubber band, or ribbon.

Often a more complex hair style then a mere ponytail is created by taking a lock of hair from a ponytail, wrapping the lock of hair about a ponytail fastener, and then inserting the lock down through the ponytail fastener. This wrap hairstyle creates an illusion that the individual's hair is the fastening means of the ponytail. This hairstyle usually is difficult to achieve without the aid of another person or some type of tool.

Another complex hair style is achieved by inverting a ponytail, that is, taking the end of the ponytail and downwardly threading it through that portion of the ponytail between the fastener and the head. This hair style also is usually difficult to achieve without the assistance of a second pair of helping hands or some type of tool.

U.S. Pat. No. 5,417,230 to Wood discloses a hair styling tool and a method for using the hair styling tool for incorporating a band of hair into a variety of hairstyles. One embodiment of Wood's hair styling tool includes an internal shaft, terminating at one end in a knob and at the other end in a U-shaped hook. As disclosed, an encasement surrounds the central portion of the internal shaft to allow limited movement of the internal shaft.

U.S. Pat. No. 5,036,870 to Edmark discloses a tool and method for inverting a hair tail into a pleasing hair style. As disclosed, the tool includes a cylindrical probe with a point on an end for inserting through the hair tail at a distance from the end of the hair tail. A loop attached to a second end of the probe for pulling the hair tail through itself to invert the hair tail.

U.S. Pat. No. 5,289,834 to Lawrence discloses a tool for threading a ponytail type of hair style within itself. The Lawrence tool includes a loop which tightens about the ponytail prior to the ponytail being pulled through the inner portion of the ponytail.

Several disadvantages existed with these prior hair tools. For example, one disadvantage was the complexity of the designs which required alignment of sliding parts for the tool to function properly. Moreover, the moving and sliding parts could snag and tangle in a user's hair, resulting in damage to the hair and pain to the user.

Another disadvantage was the difficulty one experienced when threading a hair tail through a closed loop. Often a user inadvertently did not thread all of the ponytail into the loop. As a result, the inverted hair tail would have a frayed, unkempt appearance. Thus, the user would have to rethread the loop and reinvert the hair tail.

Still another disadvantage was that the commercial embodiments were lengthy and cumbersome. This prevented a user from making multiple wraps or inversions with the same hair tail.

SUMMARY OF THE INVENTION

Briefly, the present invention provides an improved hair styling tool which is easy to use for creating a wrapped hair tail which gives the appearance that an individual's hair is the fastening means of the hair tail. Moreover, the hair styling tool is versatile because it can be used to create multiple wraps with the same hair tail. Also, the hair styling tool could be used to invert a hair tail.

The hair styling tool according to the present invention includes a hook attached to a proximal end of an arcuate handle. Adjacent to a distal end of the hook and attached to the proximal end of the handle is an arm. The hook receives a lock of hair for pulling through a ponytail and the arm prevents the hook from catching on the ponytail as the hair styling tool is pulled through the ponytail by the handle.

In operation, a person gathers the hair into a ponytail and, prior to securing the ponytail with a fastener, a lock of hair is removed from the ponytail. The distal end of the handle is inserted into the ponytail through the center of the fastener. The lock of hair is wrapped around the fastener, concealing the fastener, and slid through a gap between the distal end of the hook the arm. The lock of hair is held taught against the inside of the hook while the hair styling tool is drawn through the ponytail. The hair styling tool emerges and releases the lock into a blended ponytail.

BRIEF DESCRIPTION OF THE DRAWING

A better understanding of the present invention can be obtained when the following detailed description of the preferred embodiment is considered in conjunction with the following drawing, in which.

DETAILED DESCRIPTION OF THE PREFERRED EMBODIMENT

Figure 1:
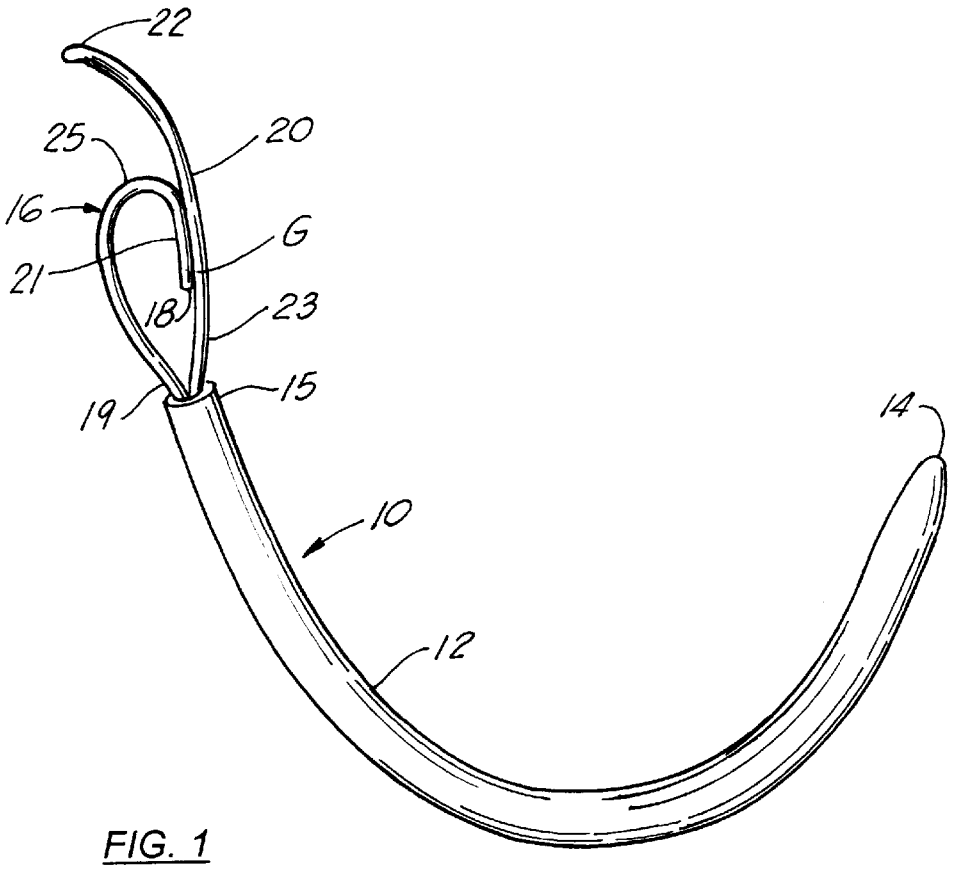
FIG. 1 is an isometric view of the hair styling tool of the present invention.

Referring now to the drawings in greater detail, a hair styling tool 10 of the present invention is shown in FIG. 1.

Figure 5:
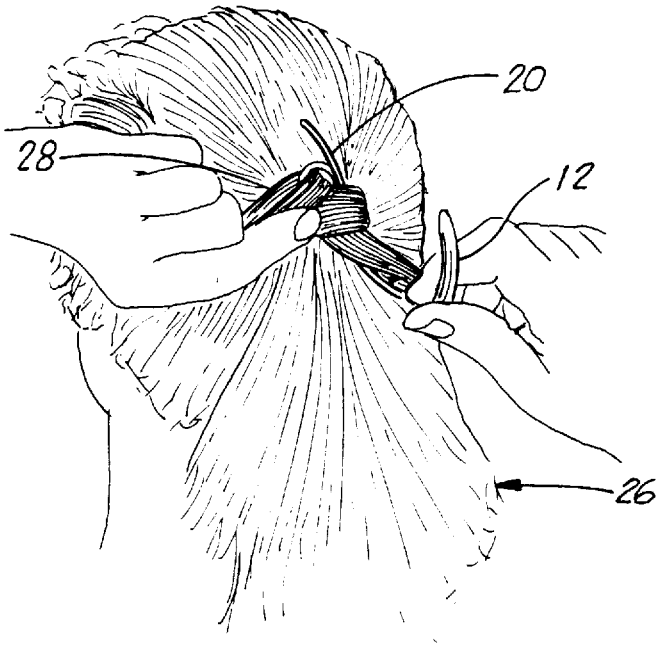

The hair styling tool 10 includes a hook 16 attached to a proximal end 15 of an arcuate handle 12. Adjacent to a distal end 18 of the hook 16 and attached to the proximal end 15 of the handle 12 is an arm 20. As shown in FIG. 5 and described in greater detail below, the hook 16 receives a lock of hair 28 for pulling through a ponytail 26 and a ponytail fastener 24 and the arm 20 prevents the hook 16 from catching on the ponytail 26 and the fastener 24 as the hair styling tool 10 is pulled through the ponytail 26 by the handle 12.

As shown in FIG. 1, the handle 12 of hair styling tool 10 is geometrically shaped in an arc to provide a convenient means for inserting (FIG. 2) and drawing the hair styling tool 10 through (FIG. 6) the ponytail 26. The curvature of handle 12 also aids the user in finding and adjusting the hair styling tool 10 within the ponytail 26 (FIG. 5) because the handle 12 curves away from the head and pokes out through the ponytail 26.

Figure 2:
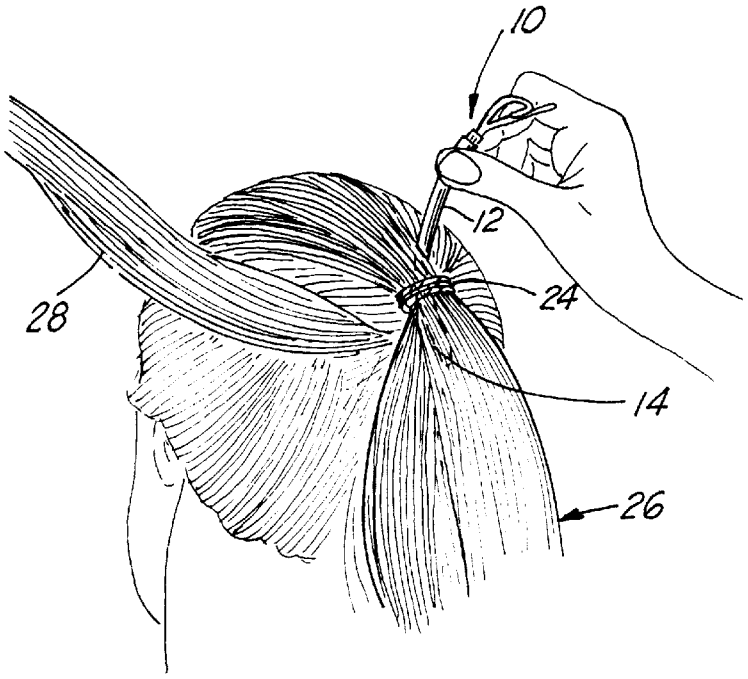
FIGS. 2–8 illustrate the use of the hair styling tool to wrap a hair tail.
Figure 6:
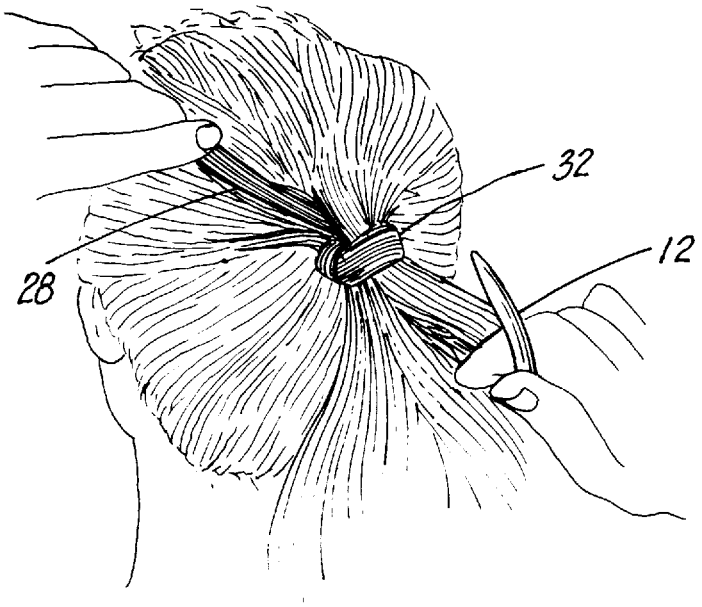

Referring to FIGS. 1 and 2, a distal end 14 of the handle 12 is adapted for safe, easy insertion into a head of hair. In general, the distal end 14 is pointed to facilitate the insertion of the handle 12 into the ponytail 26. The handle 12 is preferably constructed from relatively stiff materials, such as metal, plastic, wood, or a combination of materials. Preferably, the cross sectional shape of the handle 12 is circular or oval and has a relatively smooth surface to facilitate the handle 12 and hair styling tool 10 being drawn through the ponytail 26 (FIGS. 5–6).

As shown in FIG. 1, the hook 16 for receiving a lock of hair 28 (FIGS. 4 and 5) is generally U-shaped having a longer outside leg 19, a curved base 25, and a shorter inside leg 21 terminating at a distal end 18. The outside leg 19 of the hook 16 attaches to the proximal end 15 of the handle 12. The means for attaching the hook 16 to the handle 12 depends upon the materials used for each. For example, like the handle 12, the hook 16 can be made from any relatively stiff material such as metal, plastic, wood, or a combination of materials. Thus, if metals are used for both the handle 12 and the hook 16, some type of brazing or soldering may be used for attaching the two together. In contrast, if the hair styling tool 10 is made of plastic, the handle 12 and the hook 16 may be one molded piece of plastic or two separate pieces of plastic bonded together with some type of epoxy. Thus, as one skilled in the art can appreciate, an appropriate means for attaching the outside leg 19 of the hook 16 to the proximal end 15 of the handle 12 will depend upon the relative materials of each.

As shown in FIG. 1, the hook 16 of hair tool 10 is an open loop. That is, the distal end 18 of the hook 16 remains a distance from both the outside leg 19 of the hook 16 and the proximal end 15 of the handle 12. Thus, the hook 16 provides a convenient means for receiving a lock of hair 28 into the hair styling tool 10.

A first end 23 of the arm 20 attaches to the proximal end 15 of the handle 12. The arm 20 extends outwardly toward the distal end 18 of the hook 16, continues adjacently to the inside leg 21, and terminates a distance beyond the curved base 25 at a canted distal end 22. The space between the distal end 22 of the arm 20 and the curved base 25 should be sufficient to permit a lock of hair, e.g. lock of hair 28, to easily pass between the arm 20 and the inside leg 21 and into the hook 16. Also, as illustrated in FIGS. 1, 5, and 6, the arm 20 is shaped to prevent the distal end 18 of the hook 16 from catching on the ponytail 26 and the fastener 24 as the hair styling tool 10 is drawn through the ponytail 26.

Figure 4:
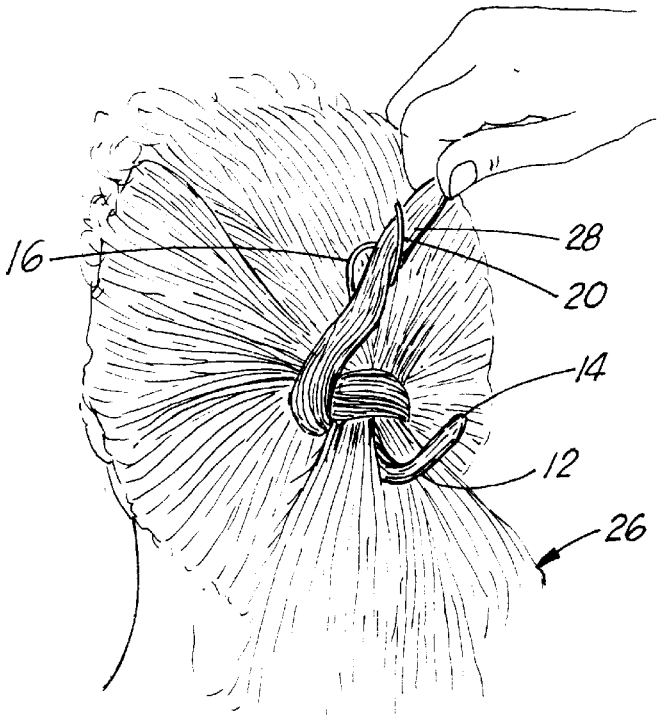

As shown in FIGS. 1, 4, and 5, the arm 20 extends beyond curved base 25 of the hook 16 to assist the user in properly locating the hair styling tool 10 for receiving the lock of hair 28. Also, the distal end 22 of the arm 20 is preferably canted or rounded to prevent the user from accidentally piercing the user's head. Additionally, when the hair styling tool 10 is drawn through the ponytail 28, the canting or rounding of the distal end 22 of the arm 20 eliminates the undesirable bunching of the hair between the head and the fastener 24.

In general, the arm 20 is made of the same relatively stiff material as the hook 16. Thus, the means for attaching the arm 20 to the handle 12 is generally the same as the means for attaching the hook 16. Additionally, as shown in FIGS. 1 and 2, it is preferable for the hook 16 and the arm 20 to have the same curvature as the handle 12 so the hair styling tool 10 will draw easily through the ponytail 26.

Referring now to FIG. 2, in operation, the user gathers a selected batch of hair into a ponytail 26 and, prior to securing the ponytail 26 with any convenient fastener 24, removes a lock of hair 28 from the ponytail 26. As can be appreciated, any type of tying device can be used as a fastener, such as a rubber band, an elastic band, or ribbon. The distal end 14 of the handle 12 (FIG. 1) is inserted into the ponytail 26 and through the center of the fastener 24.

Figure 3:
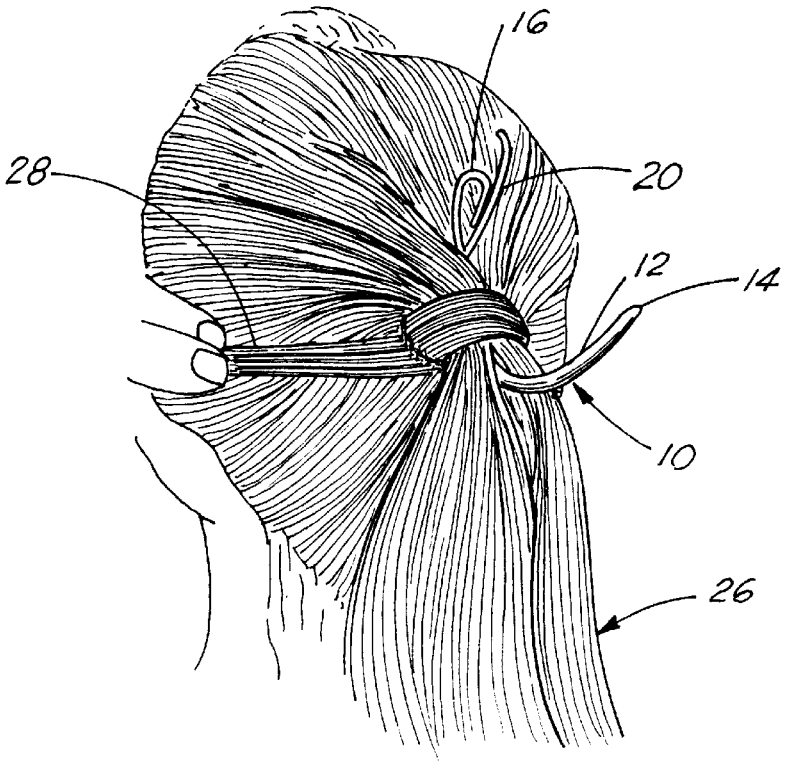

Next, as shown in FIG. 3, the removed lock of hair 28 is wrapped around the rubber band 24 and the ponytail 26 to conceal the fastener. Referring to FIG. 4, after concealing the fastener 24 (shown in FIG. 2), the lock of hair 28 is passed between the shorter leg 21 of the hook 16 and the arm 20. As shown in FIG. 5, prior to pulling the handle 12 of the hair styling tool 10 through the ponytail 26, the lock of hair 28 is pulled taught against the hook 16. Referring to FIG. 6, once the lock of hair 28 is in the proper position within the hook 16, the user grasps the handle 12 and draws the hair styling tool 10 through the center of the fastened ponytail 26, thereby threading the lock of hair 28 through the ponytail 26. The hair styling tool 10 emerges and releases the lock of hair 28 into a blended ponytail 26.

Figure 7:
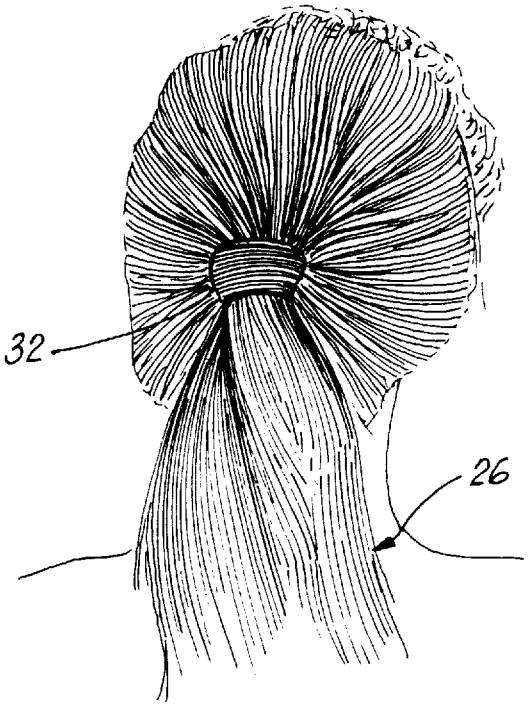

Referring to FIG. 7, using the hair styling tool 10 an attractive wrap 32 results from pulling the lock of hair 28 through the ponytail 26. By concealing the rubber band 24 with the user's own hair, the wrap provides the illusion that the user's hair is fastening the ponytail 26. This complex hair wrap 32 is easy to create because the hair styling tool 10 does not require threading the lock of hair 28 through a closed loop.

Figure 8:
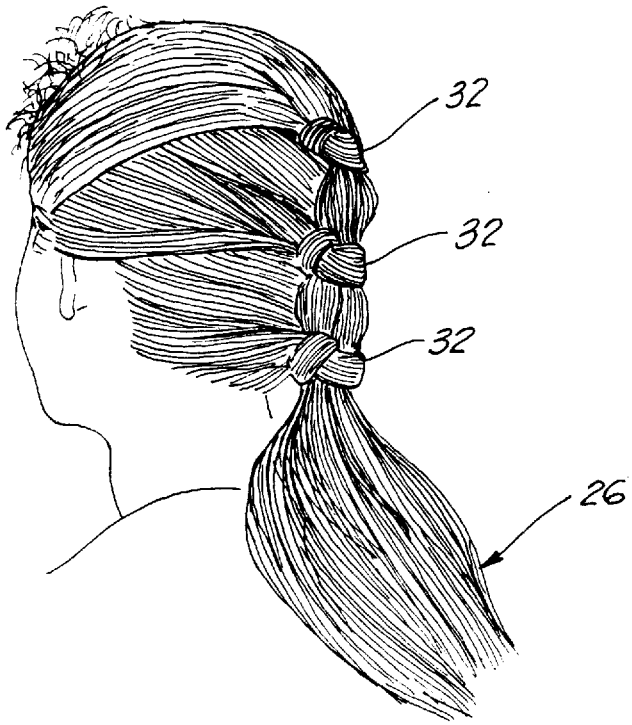

As shown in FIG. 8, the procedure for creating the wrap may be repeated several times with the same ponytail. Creating multiple wraps is easy because the hair styling tool of the present invention requires a relatively short handle length. Moreover, the hair styling tool of this invention is simple to use because there are no moving parts to bind when securing a lock of hair in the tool's U-shaped hook.

As can now be appreciated, the hair styling tool of the present invention can also useful for creating an inverted ponytail hair style. To invert a ponytail, the hair styling tool 10 is inserted between a fastener 24 and the scalp. Next, the entire ponytail 26 is passed between the distal end 18 of the hook 16 and the arm 20. For this hair style, a lock of hair is not removed for wrapping about the hair fastener. Once the ponytail 26 is completely inside the hook 16, the hair styling tool 10 is drawn through the ponytail, between the fastener and the scalp. The result is a ponytail that is threaded through itself.

The hair styling tool of the present invention can be used on any sufficiently long head of hair, and on dolls, wigs, or animals.

The foregoing disclosure and description of the invention are illustrative and explanatory thereof, and various changes in materials, sizes, and configurations, as well as methods of use and particular hair styles may be made without departing from the spirit of the invention, the scope of which is defined in the following claims.

What is claimed is:

1. A hair styling tool comprising:

a handle having a first end and a second end;

a U-shaped hook secured to and extending outwardly from the first end of the handle, said hook having a distal end, an outside leg, an inside leg, and a base connecting said outside leg to said inside leg; and an arm, having a first end and a second end, said first end secured to said handle, said arm extending outwardly from said handle toward said distal end of said hook, continuing adjacently to said inner leg of said hook, and said arm terminating a distance beyond said base.

2. The hair styling tool of claim 1 wherein said second end of said handle terminates in a rounded tip.

3. The hair styling tool of claim 1 wherein said second end of said handle terminates in a pointed tip.

4. The hair styling tool of claim 1 wherein said handle includes an oval cross section.

5. The hair styling tool of claim 1 wherein said handle is arcuately shaped.

6. The hair styling tool of claim 5 wherein said hook attached to said handle generally traces the same arc as said handle.

7. The hair styling tool of claim 5 wherein said arm attached to said handle generally traces the same arc as said handle.

8. A method for threading a lock of hair from a ponytail through a ponytail fastener using a hair styling tool comprising a handle with a U-shaped hook secured to and extending outwardly from a first end of said handle, said hook having a distal end, an outside leg, an inside leg, and a base connecting said outside leg to said inside leg, and an arm secured to and extending outwardly from said first end of said handle toward said distal end of said hook, continuing adjacently to said inner leg of said hook, and terminating at a distance beyond said base, the method comprising the steps of:

gathering hair into a ponytail;

removing a lock of hair from said ponytail;

securing said ponytail with a fastener without including said lock of hair;

inserting said handle into said ponytail and through said fastener;

wrapping said lock of hair about said fastener;

sliding said lock of hair between said arm and said second leg of said hook;

pulling said lock of hair tightly against said U-shaped hook;

pulling said hair styling tool with said lock of hair through said fastener and ponytail; and releasing said lock of hair from said hair styling tool.

* * * * *